United States Patent [19]

Vercillo

[11] Patent Number: 4,989,740

[45] Date of Patent: Feb. 5, 1991

[54] COMPOSITE CAP INCLUDING TAMPER INDICATING FEATURE

[75] Inventor: Peter A. Vercillo, Hinsdale, Ill.

[73] Assignee: Continental White Cap, Inc., Norwalk, Conn.

[21] Appl. No.: 489,533

[22] Filed: Mar. 7, 1990

[51] Int. Cl.[5] ..... B65D 41/34

[52] U.S. Cl. ..... 215/252; 215/318

[58] Field of Search ..... 215/252, 232, 233, 258, 215/318, 330; 220/256, 289

[56] References Cited

U.S. PATENT DOCUMENTS

| | | | |
|---|---|---|---|
| 1,548,459 | 8/1925 | Hammer | 215/330 |
| 2,001,248 | 5/1935 | Greene | 220/256 |
| 2,888,159 | 5/1959 | Fields | 215/252 X |
| 3,270,904 | 9/1966 | Foster et al. | 215/318 |
| 3,690,503 | 9/1972 | Curry | 220/289 |
| 3,741,423 | 6/1973 | Acton et al. | 215/318 |
| 4,560,076 | 12/1985 | Boik | 215/252 |
| 4,603,786 | 8/1986 | Lecinski, Jr. et al. | 215/318 |
| 4,610,367 | 9/1986 | Massott et al. | 215/252 |
| 4,746,026 | 5/1988 | Leonhardt | 215/252 |
| 4,801,029 | 1/1989 | Begley | 215/252 X |

FOREIGN PATENT DOCUMENTS

| | | | |
|---|---|---|---|
| 473429 | 1/1975 | Australia | 215/318 |

*Primary Examiner*—Stephen Marcus
*Assistant Examiner*—Vanessa M. Roberts
*Attorney, Agent, or Firm*—Charles E. Brown; Paul Shapiro; Charles A. Brown

[57] ABSTRACT

This relates to a composite closure which incorporates the conventional closure of the press-on, twist-off type including a metal shell having in the center of an end panel thereof a tamper indicating button. The composite closure includes an overcap which is frictionally interlocked with the shell and wherein the shell has been modified so that the curl at the lower edge of the skirt thereof is outturned as opposed to being inturned and the rougher coating for receiving the sealing compound increases the frictional connection between the overcap and the metal shell. In addition, the overcap is provided with a tamper indicating band which is interlocked with the container finish so as to prevent both axial upward movement and circumferential movement of the tamper indicating band relative to the container finish. This permits, with controlled tolerances, an interlocking relation between the composite closure and the container wherein when the composite closure is twisted to removed the same the tamper indicating band will be first released and thereafter the seal between the closure and the container is broken and the tamper indicating button will pop-up in a normal manner.

18 Claims, 1 Drawing Sheet

COMPOSITE CAP INCLUDING TAMPER INDICATING FEATURE

This invention relates to new and useful improvements in closures for containers and more particularly to a closure for a container wherein the closure includes a button which is drawn by a vacuum within an associated container and everts when the vacuum is released. The invention also relates to a closure of this type having a tamper evident feature.

It is well known in the trade to provide a closure which includes a metal shell forming an end panel and a depending skirt with the skirt terminating in an inwardly turned curl. Such metal shell is lined with a sealing compound which extends along an outer peripheral portion of the end panel and down along the skirt. The closure is applied to a container which is provided with threads to facilitate the twisting off of the closure. The closure is applied by pressing it on with the sealing compound which lines the shell skirt interlocking and forming its own threads about the threads of the container.

The existing closure may also include a button in the center of the end panel for indicating the loss of a vacuum within the container.

In accordance with this invention, the existing closure is modified by foreshortening the skirt and modifying the curl so that it is outturned as opposed to being inturned.

Next, the existing closure is modified by the addition of an overcap which has a friction fit with the metal shell so that the overcap may be utilized for turning the metal shell in the removal of the closure.

It is also proposed to provide the overcap with a depending tamper indicating band which is secured to the lower part of the overcap by a plurality of sircumferentially spaced rupturable bridges. The tamper indicating band is provided with lower ribs which engage beneath a retaining bead on the container so as to prevent axial movement of the tamper indicating band and with axially extending, circumferentially spaced ribs on the container below the retaining bead so as to prevent circumferential movement of the tamper indicating band.

Most particularly, it is proposed to utilize the coating on the interior of the metal shell which is provided to obtain a good bond of the sealing compound with the metal shell to form a frictional interlock between the metal shell and the overcap. This is accomplished by way of the outturned curl. Further, it is proposed to so proportion the closure whereby when it is applied, the ribs on the tamper indicating band tightly engage beneath the retaining bead on the container so that when the closure is rotated to effect the twisting off of the closure, the tamper indicating band will rupture before the seal between the closure and the container is broken. When the metal shell is provided with a tamper indicating button, the tamper indicating band will be released before the button everts to indicate a breaking of the seal between the closure and the container.

With the above and other objects in view that will hereinafter appear, the nature of the invention will be more clearly understood by reference to the following detailed description, the appended claims, and the several views illustrated in the accompanying drawings.

Figure 1:
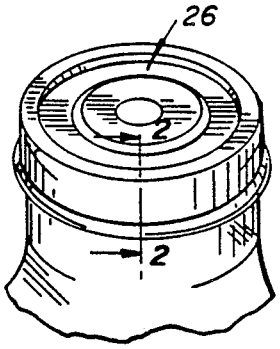
FIG. 1 is a fragmentary top perspective view of a prior art closure and container neck finish assembly.
Figure 2:
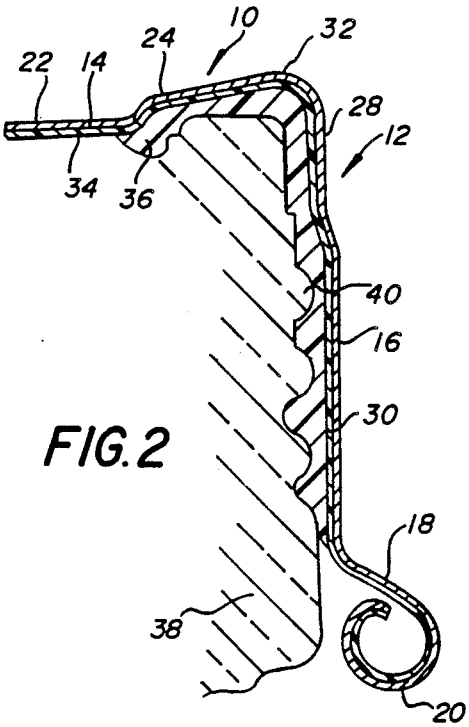
FIG. 2 is a fragmentary vertical sectional view taken generally along the line 2—2 of FIG. 1 and shows more specifically the details of the prior art closure.
Figure 6:
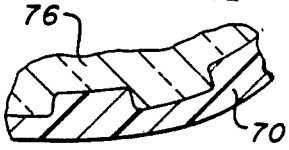
FIG. 6 is an enlarged fragmentary horizontal sectional view showing the interlock between ribs on the tamper indicating band and ribs on the container.

Referring now to the drawings in detail, reference is first made to FIGS. 1 and 2 wherein there is illustrated a prior art closure which has been improved in accordance with this invention. The prior art closure is generally identified by the numeral 10 and includes a metal shell generally identified by the numeral 12. The metal shell includes an end panel 14 and a depending generally cylindrical skirt 16. The skirt 16 terminates at its free edge in an outturned portion 18 which carries an inturned curl 20.

The end panel 14 includes a generally flat central portion 22 surrounded by an inwardly opening channel 24. The central portion 22 is provided at the center thereof with a tamper indicating button 26 as is best shown in FIG. 1.

Further, the skirt 16 includes an upper portion 28 and a lower portion 30 of different diameters with the diameter of the lower portion 30 being greater than the diameter of the upper portion 28.

The shell 12 normally has the exterior thereof coated or painted as at 32 so as to provide a relatively slippery surface. On the other hand, the inner surface of the shell 12 is provided with a coating 34 which is of a roughened texture as compared to that of the coating 32 so as to facilitate the bonding of sealing compound 36 to the interior of the shell 12 in the area shown in FIG. 2. It will be seen that the sealing compound 36 is in the channel 24 and further lines the skirt 16.

The closure 10 is of the press-on, twist-off type and is specifically configurated for use with a container such as the container 38 which is provided with a suitable thread arrangement 40 which may be either of the single continuous type or of the multiple lead type.

In common usage, the closure 10 is associated either with a hot fill product or with a product which must be retorted. In both instances, a vacuum is formed within the container and the button 26 moves downwardly to indicate a proper seal. When the vacuum within the container 38 is lost, such as by removal of the closure 10, the button 26 will evert or pop-up to indicate such vacuum loss and possible tampering.

While the closure 10 has proved satisfactory for its intended use, in view of the numerous tampering scares, packers, particularly packers of baby food, desire a closure which will provide more evidence of tampering. As a result, in accordance with this invention, there has been developed a composite closure which is generally identified by the numeral 50 and is best illustrated in FIGS. 3–6.

For all practical purposes, the closure 50 incorporates the closure 10. However, as is clearly shown in FIG. 5, the shell 12 is foreshortened and in lieu of the outturning 18 and curl 20 which is clearly shown in FIG. 2, the skirt 16 is foreshortened and is provided with an outturned curl 52. The outturned curl 52 further may be of a lesser diameter than the curl 20. In addition, by providing the outturned curl, the coating 34 which is on the interior of the shell 12 is disposed on the outer surface of the curl 52 as opposed to being on the inner surface of the curl 20.

Most particularly, the composite closure 50 includes a separately formed overcap generally identified by the numeral 54 and formed of a suitable plastic material. The overcap 54 is provided with knurls 56 to facilitate the gripping and twisting thereof. The overcap 54 has an upper portion 58 which is telescoped over the skirt 16 and a thickened lower portion 60 which is provided with an annular notch or groove 62. The curl 52 has a snap fit in the groove 62 and thus is in frictional engagement with the thickened portion 60 of the overcap 54. If desired, there may be an interference fit between the curl 52 and the walls of the groove 62. It has been found that an interference fit approximately between 0.005"-0.015" is satisfactory although this figure may vary. On the other hand, most particularly, the roughened coating 34 provides for the desired frictional interlock between the overcap 54 and the shell 12.

In addition, the body 58 of the overcap 54 may have an interference fit with the skirt 16.

Although the overcap 50 has been illustrated as extending up beyond the shell 12 and terminating in the radially inwardly directed transverse flange or crown 64 which overlies the channel 24, it is feasible to eliminate the flange or crown 64.

The overcap 54 has a function other than being utilized for the purpose of rotating and twisting-off the closure 50. In accordance with this invention, there is provided a lower tamper indicating band 66 which is connected by way of a plurality of circumferentially spaced, axially extending, rupturable bridges 68 to the lower edge of the enlargement 60. Further, the lower part of the tamper indicating band 66 is provided with a plurality of axially extending, circumferentially spaced ribs 70. The ribs 70 have two functions as will be described hereinafter.

First, it is to be understood that the illustrated container 38A is modified to include an enlargement 72 which is provided with a retaining bead 74 for retaining the tamper indicating band 66 on the container 38A.

Below the retaining bead 74, the container 38A is provided with a plurality of axially extending, circumferentially spaced ribs 76 with which the ribs 70 of the tamper indicating band 66 engage so as to prevent circumferential movement of the tamper indicating band 66 relative to the container 38A. Further, the axial position of the retaining bead 74 and the ribs 70 are one wherein when the composite closure 50 is applied to the container 38A, the ribs 70 snap beneath the retaining bead 74 in tight engagement. The net result is that the relationship of the composite closure 50 with respect to the container 38A is that when one twists the overcap 54 and thus twists the metal shell 12, to remove the closure 50, before the seal between the closure 50 and the container 38A is lost, the bridges 68 will rupture and the tamper indicating band 66 will drop down. Further twisting of the composite closure 50 will result in the loss of the seal between the sealing compound and the upper part of the container 38A so that the vacuum will be lost and the button 26 will pop.

Finally, it is to be understood that the enlargement 72 is also provided with other ribs 78 which are located above the retaining bead 74. The ribs 78 are axially extending and circumferentially spaced in the same manner as the ribs 76 and are in axial alignment therewith. The purpose of the ribs 78 is to provide a prealignment of the ribs 70 with the ribs 76 before the closure 50 is fully pressed on the container 38A.

Figure 5:
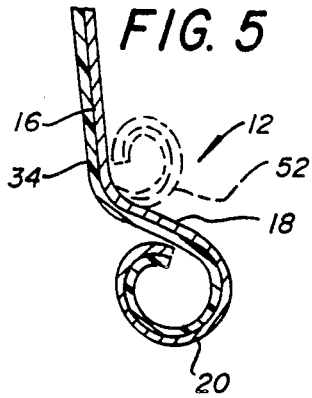
FIG. 5 is a schematic fragmentary vertical sectional view showing the saving in metal effected utilizing an outturned curl.
Figure 3:
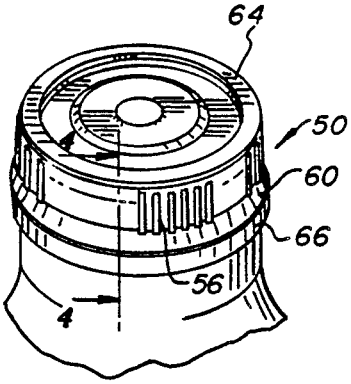
FIG. 3 is a fragmentary top perspective view showing a closure formed in accordance with this invention.
Figure 4:
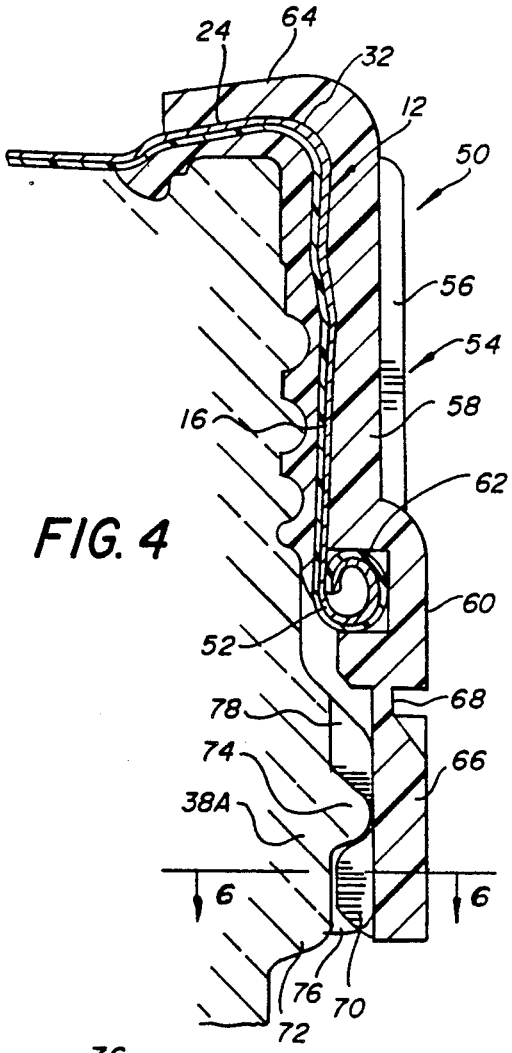
FIG. 4 is an enlarged fragmentary vertical sectional view taken generally along the line 4—4 of FIG. 3 and shows the specific details of the closure which is the subject of this invention.

At this time, it is particularly pointed out that while the cost of the plastic overcap 54 does add to the overall cost of the composite closure 50 as opposed to the cost of the closure 10, there is a definite savings in metal as is clearly shown in FIG. 5 and discussed here and above. Comparing FIGS. 2 and 4, it is to be noted that the interior vertical portion of the shell 12 that functionally starts at the point where the plastisol sealant 36 contacts the container finish is approximately 0.030" above the outturned curl 52 in the composite closure 50. It has been possible to increase the interior vertical height of the outturned curl by approximately 0.045" and reduce the metal savings by approximately 11% as compared to the shell 20 as illustrated in FIG. 2. Additionally, and even more important, the 0.090" approximate height differential between the outturned curl 52 and the conventional inturned curl 20 enables the plastic overcap 54 to be shortened by the same amount, thus realizing plastic material savings, plus reduced finished height on the closure.

Attention is also directed to the fact that the outturned curl 54 can be produced more readily and with a smaller diameter than with the inturned curl 20. The metal edge, because of its normal blanking process, contains the smooth (somewhat rounded) corner on the inside of the cap shell, which provides a starting lead for the curl forming process. Contrary, the rougher edge is on the outside of the drawn cap shell, and it must be overcome to produce an inturned curl typically making it more difficult to produce a small curl. Also, to produce an outturned curl, the metal is simply outwardly curled from the inside shell diameter. However, to produce an inside curl for the conventional closure, as shown in FIG. 2, the lower portion of the shell has to be stepped out prior to forming the curl, a process requiring additional material. The conventional inturned curl diameter is approximately 0.060", while the outturned curl diameter may be small, for example, ranging from 0.040" to 0.045".

Although only a preferred embodiment of the composite closure has been specifically illustrated and described herein, it is to be understood that minor variations may be made in the closure without departing from the spirit and scope of the invention as defined by the appended claims.

I claim:

1. A closure of the press-on twist-off type, said closure comprising a metal shell including an end panel and a generally cylindrical skirt terminating in a curl, and sealing compound in said shell lining a radially part of said end panel and said skirt, said shell having an internal coating facilitating bonding of said sealing compound, said closure being improved by an overcap telescoped over said shell and engaged over said curl for effecting twisting of said shells to remove said closure from a container, said curl being outturned with said coating being disposed outermost and forming a friction interlock with said overcap.

2. A closure according to claim 1 wherein said overcap has a radially inwardly opening annular notch receiving said curl.

3. A closure according to claim 1 wherein said overcap has a radially inwardly opening annular notch receiving said curl with an interference fit.

4. A closure according to claim 1 wherein said overcap has an inference fit with said skirt above said curl.

5. A closure according to claim 2 wherein said overcap has an inference fit with said skirt above said curl.

6. A closure according to claim 3 wherein said overcap has an inference fit with said skirt above said curl.

7. A closure according to claim 4 wherein said skirt has upper and lower portions of different diameters with said lower portion having the greater diameter.

8. A closure according to claim 1 wherein said closure includes a lowermost tamper indicating band integrally joined to said overcap by rupturable bridges.

9. A closure according to claim 8 wherein said tamper indicating band has a radially inwardly directed part for engagement below a container retaining bead to retain said tamper indicating band on a container and effect rupture of said bridges when said closure is removed.

10. A closure according to claim 9 wherein said radially inwardly directed part is spaced below said curl a distance wherein when said closure is being removed said bridges will rupture before a seal between said closure and a container is broken.

11. A closure according to claim 10 wherein said end panel has a tamper indicating button, and said bridges rupture before said button everts to indicate the loss of the seal.

12. A closure according to claim 9 wherein said radially inwardly directed part is in the form of circumferentially spaced ribs for interlocking with radially outwardly directed circumferentially spaced container aligning ribs.

13. A closure according to claim 12 wherein said tamper indicating band has second circumferentially spaced ribs spaced above said radially inwardly directed part and axially aligned with the first mentioned circumferentially spaced ribs.

14. A closure according to claim 8 in combination with a container having a threaded neck finish and a retaining bead below said threaded neck finish, and said tamper indicating band having a radially inwardly directed part tightly engaged said retaining bead in an axial direction to prevent axial tamper indicating band travel wherein when said closure is removed said bridges will rupture before a seal between said threaded neck finish and said closure is broken.

15. The combination of claim 14 wherein said end panel has a tamper indicating button, and said bridges rupture before said button everts to indicate the loss of the seal.

16. The combination of claim 14 wherein said container has radially outwardly projecting circumferentially spaced ribs below said retaining bead, and said radially inwardly directed part is in the form of circumferentially spaced ribs interlocked with said container ribs for preventing circumferential movement of said tamper indicating band.

17. The combination of claim 16 wherein said container has radially outwardly projecting circumferentially spaced ribs above said retaining bead for initial engagement by said closure ribs to prealign said closure ribs.

18. The combination of claim 17 wherein the container ribs above and below said retaining bead are of like circumferential extent and spacing and are axially aligned.

* * * * *